United States Patent [19]

Frielinghaus

[11] 4,351,504

[45] Sep. 28, 1982

[54] TRACK CIRCUIT PRINCIPLE WHEEL DETECTOR

[75] Inventor: Klaus H. Frielinghaus, Rochester, N.Y.

[73] Assignee: General Signal Corporation, Stamford, Conn.

[21] Appl. No.: 127,281

[22] Filed: Mar. 5, 1980

[51] Int. Cl.[3] ..... B61L 13/04

[52] U.S. Cl. ..... 246/249; 246/122 R; 246/247

[58] Field of Search ..... 246/247, 249, 122 R, 246/169 R, 187 B, 34 R, 34 CT; 340/38 L; 324/237, 228, 234, 243

[56] References Cited

FOREIGN PATENT DOCUMENTS

| | | | |
|---|---|---|---|
| 1530369 | 4/1970 | Fed. Rep. of Germany | 246/247 |
| 2655057 | 3/1978 | Fed. Rep. of Germany | 246/187 B |
| 52-49509 | 4/1977 | Japan | 246/122 R |
| 645884 | 2/1979 | U.S.S.R. | 246/249 |
| 650865 | 3/1979 | U.S.S.R. | 246/249 |

OTHER PUBLICATIONS

*Railway Signaling and Communications*, Aug. 1965, pp. 22, 24.

*Primary Examiner*—James J. Groody

*Attorney, Agent, or Firm*—Milton E. Kleinman; John Ohlandt

[57] ABSTRACT

Apparatus for detecting the presence and position of individual wheels or wheel-axles of railroad cars. The apparatus involves no moving parts and basically senses the presence of a car wheel by sensing a shunt current flowing through the car wheel-axle set. The apparatus or system includes a transmitter which develops a high frequency AC signal which is impressed across the rails, and a sense or pick-up coil which is sensitive to the fields produced by currents flowing up through the radius of the wheel, whereas it is substantially unaffected by fields produced by the currents flowing in the rails. A pair of current-carrying loops is provided, the first loop including a pair of rails and a pair of boundary shunts connecting said rails; the first loop being subdivided for current flow into two substantially equal portions with respect to a detection zone center line; the second loop extending in close proximity to and inside said first loop, said second loop likewise being subdivided for current flow.

7 Claims, 8 Drawing Figures

FIG. 6
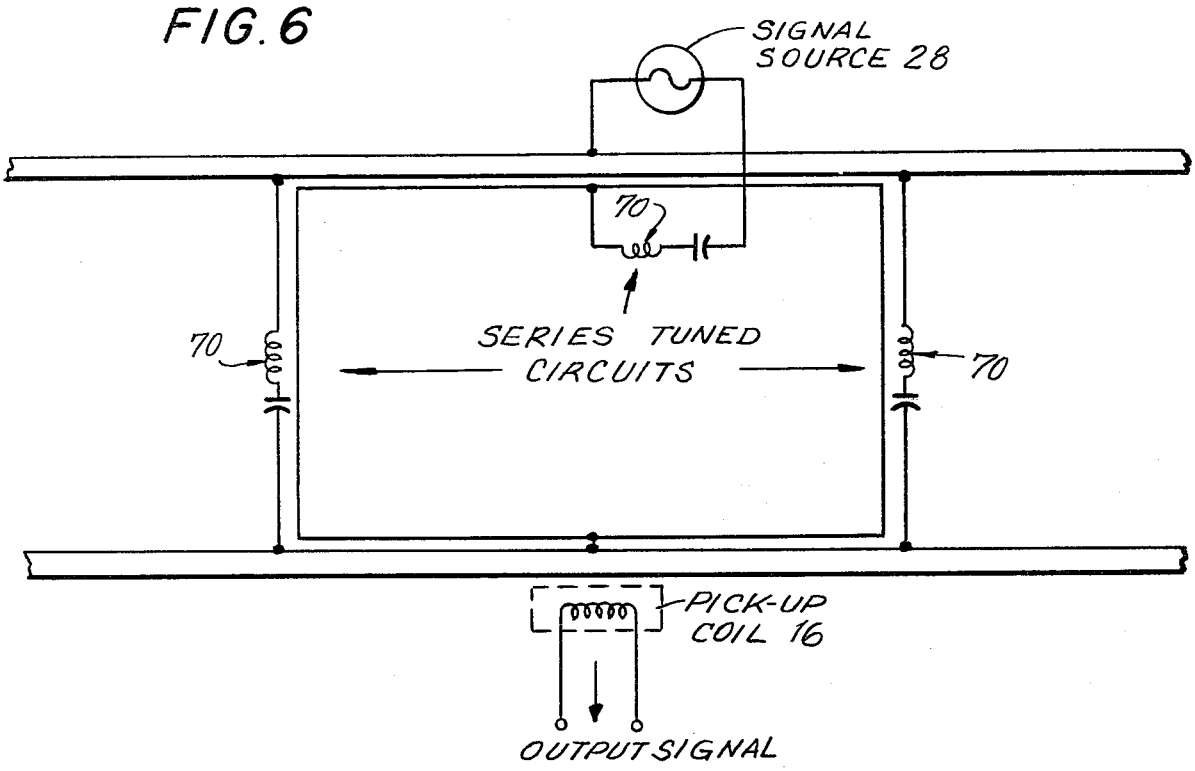
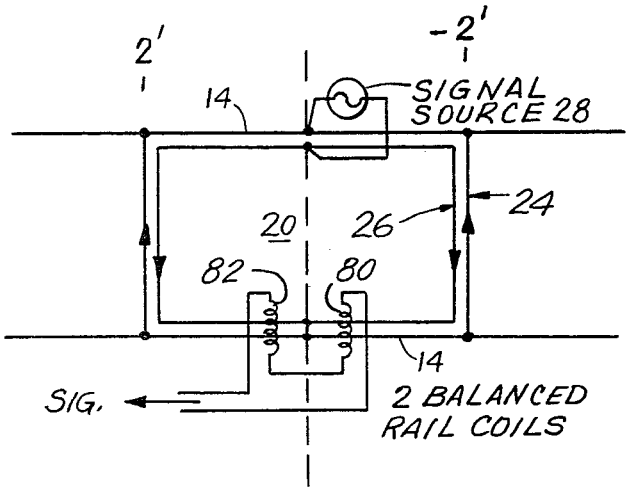
FIG. 7
FIG. 8
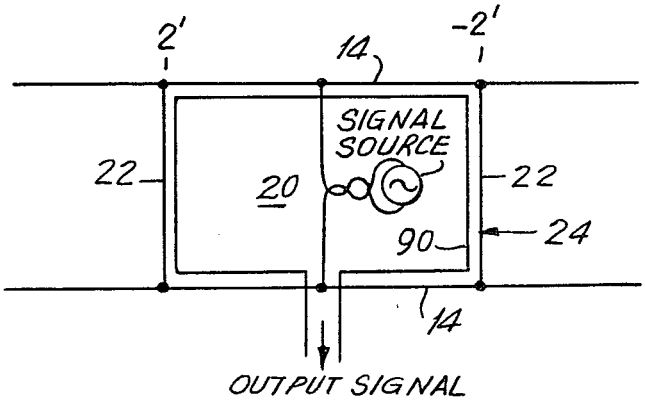

TRACK CIRCUIT PRINCIPLE WHEEL DETECTOR

BACKGROUND, OBJECTS AND SUMMARY OF THE INVENTION

The present invention relates to detection apparatus and, more particularly, to apparatus for detecting the presence and position of individual wheel-axles of railroad cars.

As background material for an understanding of the apparatus and technique of the present invention, reference may be made to the following patents: British Pat. No. 767,724; U.S. Pat. No. 3,697,745; and U.S. Pat. No. 4,058,279, the last named being assigned to the assignee of the present invention and in which there is described a system or apparatus for detecting wheel "flats". In accordance with such system, a pair of individual test sections is established and a pair of loops for detecting or sensing the wheel "flats" is correlated with the respective test sections. Each of the loops includes a pair of pick-up coils connected in opposing polarity such that under "no wheels present" conditions the voltage produced in each of the pair of coils is substantially identical such that a zero net output voltage is produced in a detection loop; whereas, when a wheel-axle is present in one of the test sections, one of the pair of coils is "shorted out" such that the output voltage abruptly rises for that detection loop. However, the output voltage falls again whenever a wheel flat occurs.

Unlike the system of the aforenoted U.S. Pat. No. 4,058,279, the system of the present invention is directed to detecting the presence of individual wheel-axles and of providing a reasonably precise indication of the position within such test or detecting section.

Accordingly, it is a primary object of the present invention to provide apparatus that will permit detection of the presence of wheel-axles in a detecting section.

An ancillary object is to provide a convenient measurement for ascertaining the position within the detecting section of the wheel-axles.

In fulfillment of the above-noted objects, a primary feature of the present invention resides in a system for detecting the presence and position of railroad car wheels in which a transmitter having a high-frequency output is connected to a pair of rails which, together with suitable shorting means, constitute a first loop for the flow of the high frequency current from said transmitter. A second loop extends in close proximity to said first loop and a sensing means associated with the loops functions to sense the changes in fields resulting when a wheel-axle combination comes into the test or detection zone.

Preferably, the sensing means takes the form of a pick-up coil positioned adjacent one of the loops. By reason of countercurrent flows established in the two loops, the fields produced by the loop currents are normally canceled and minimized in the vicinity of the pick-up coil. However, when a wheel-axle is present in a test or detection zone, the pick-up coil produces a relatively sharp position response with respect to that wheel or wheel-axle combination.

In a preferred embodiment the transmitter is connected in series with both of the current loops and is further so connected so that the loops are normally subdivided into two equal portions with respect to a center line; additionally, the pick-up coil is positioned to be aligned along that center line.

Other and further objects, advantages and features of the present invention will be understood by reference to the following specification in conjunction with the annexed drawing, wherein like parts have been given like numbers.

BRIEF DESCRIPTION OF THE DRAWING

FIG. 6 is an alternate embodiment in accordance with the present invention for the situation in which a frequency discriminating arrangement is required;

FIG. 7 is another alternate embodiment involving the use of two balanced pick-up coils for sensing current changes;

FIG. 8 is yet another alternate embodiment in which the source or transmitter is connected in shunt directly across the rails.

DESCRIPTION OF PREFERRED AND ALTERNATE EMBODIMENTS

Figure 1:
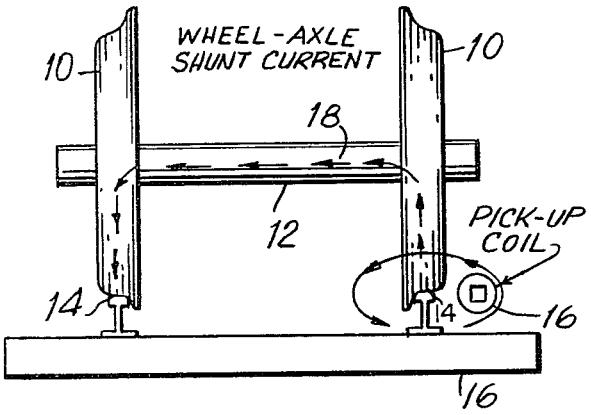
FIG. 1 is a diagrammatic showing of a typical wheel-axle in contact with a pair of rails and particularly illustrating the flow of wheel-axle shunt current.
Figure 2:
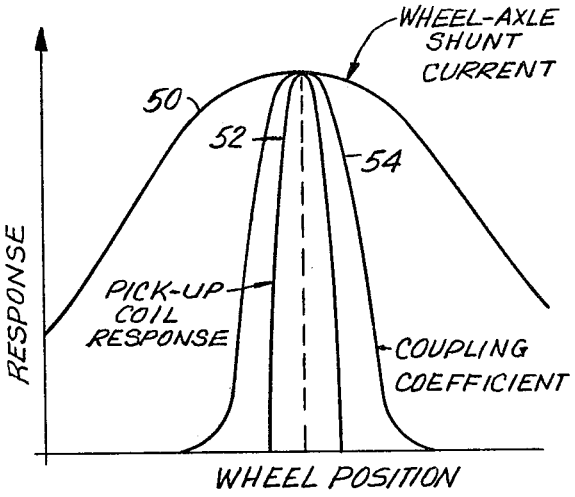
FIG. 2 is a graph illustrating response versus wheel position and, in particular, the wheel-axle shunt current variation, the pick-up coil response and the coupling coefficient; the wheel position being indicated with respect to a center line.
Figure 3:
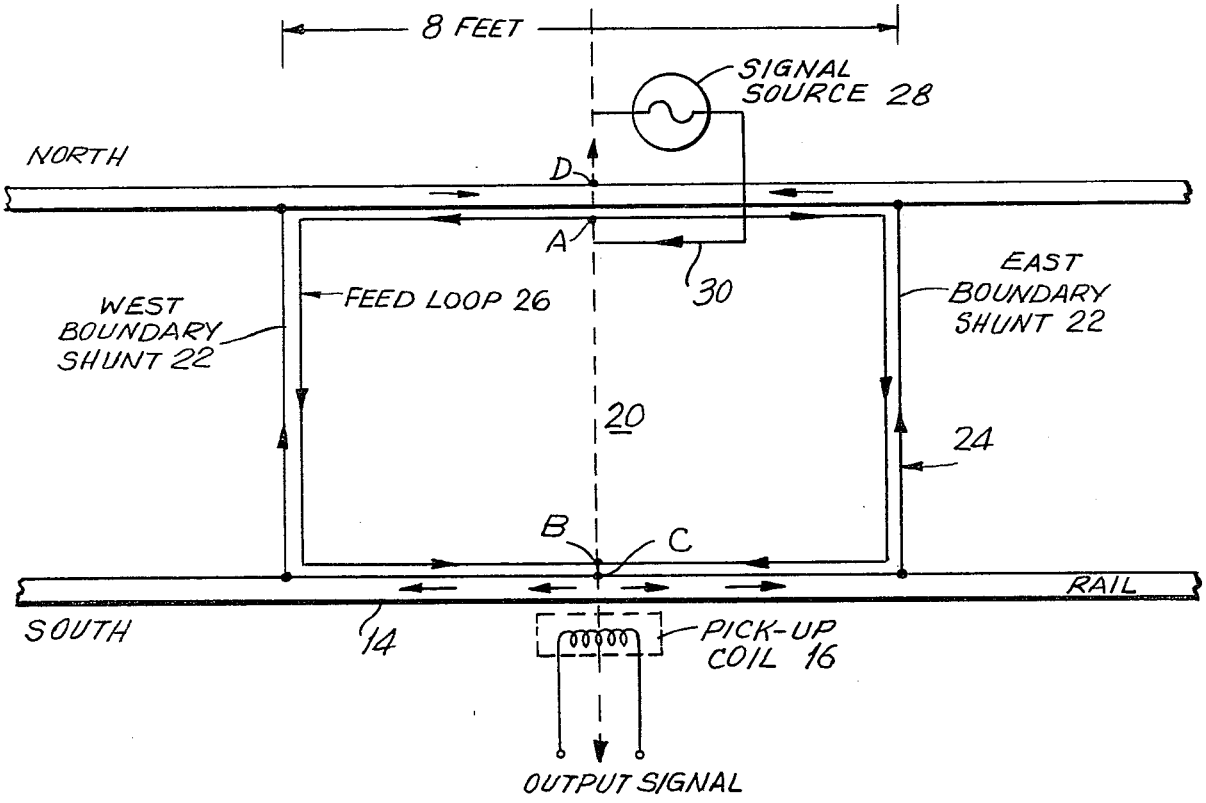
FIG. 3 is a schematic diagram illustrating a preferred embodiment of the wheel detector system of the present invention.

Referring now to FIGS. 1–3, the detection system in accordance with a preferred embodiment for detecting the presence and position of wheel-axles in a test or detection zone is illustrated. In FIG. 1 a pair of wheels 10 mounted on an axle 12, as typically found on a railroad car or the like, is shown with respect to a pair of rails 14 located on a railroad bed. There will be seen a pick-up coil 16 located adjacent one of the rails 14. For convenience, this is referred to as the south rail. The flow of a wheel-axle shunt current is indicated by arrows 18.

Referring now particularly to FIG. 3, there will be seen a schematic diagram of the complete system in which the north and south rails 14 and pick-up coil 16 are illustrated. A detection zone 20 is shown, comprising portions of the north and south rails bounded by the boundary shunts 22 so as to define a first or detection loop generally designated 24. A second or feed loop 26 extends within the first loop 24 and a signal source 28 is shown connected at point A to the inner loop 26 so that a current designated 30 flowing from the signal source 28 enters the inner or feed loop 26 at point A, at which point this current subdivides and flows in the two equal halves of the loop 26. It will be noted that point A is preferably located on a center line of the detection zone 20 so that a normally equal division of current 30 occurs into the two halves of loop 26.

A connection is made from the point B at the lower part of loop 26 to point C in the outer loop 24, comprising the portions of the rail 14, as aforenoted, together with the boundary shunts 22 such that the current 30 is again split into the two halves of loop 24 and is returned from the north rail at point D to the other side of signal source 28. As was the case previously with point A, the connection points B, C and D are on the center line of the detection zone 20.

Pick-up coil 16 is located adjacent to south rail 14 and its mid-point is appropriately located on the center line of detection zone 20. Of course, it will be appreciated that since the flow of the current in the two halves of the respective loops 24 and 26 is opposite to each other, the fields produced by the currents in these two loops also oppose each other, hence there is no net field. Also the orientation of the sense or pick-up coil 16 is such that it is not sensitive to fields produced by currents in the inner loop 26, and the rail loop 24. As a result there is little or no output from the sense coil due to the currents in these two loops either when there are wheel-axle sets or no wheel-axle sets in the detection zone 20, due to field cancellation and/or orientation of the sense coil 16. Furthermore, since the orientation of the sense coil 16 is such as not to be sensitive to currents flowing in the rails 14, the sense coil is immune to pickup of foreign signal currents flowing in the rails such as traction currents and track circuit currents.

Another advantage of this field canceling feed arrangement is that it minimizes the source impedance of the signal source by drastically reducing the signal feed impedance. This enhances the performance of this detection system since the signal source acts like a constant voltage source thus maximizing the wheel-axle shunting current that can be generated. This tends to also minimize the interferring loading effect of adjacent wheel-axle sets which is covered later in this patent description.

Referring now to FIG. 2, the Y or ordinate of the graph is denominated response, while the X or abscissa represents wheel position, it being apparent that the wheel position is measured with respect to the aforenoted center line of the detection system of FIG. 3. Accordingly, the distance of this center line with respect to the origin of the graph is approximately 3.5 feet, taken to be positive; likewise for the opposite or negative direction along the X axis from the center line. The curve 50 illustrates the relationship between wheel-axle shunt current 18 and wheel position. It will be seen that at a point indicated as approximately 3.5 feet from the center line, a significant wheel-axle shunt current results and this is a consequence of the presence of a wheel-axle combination within the detection zone having the effect of significantly reducing the impedance which the signal source sees because of the nearer shunting effect of the wheels 10 and axle 12 when compared with the effect produced by boundary shunt 22 at the far left end of detection zone 20 (otherwise known as the west end).

The maximum value of shunt current produced is when the wheel-axle combination arrives at the center line location so as to shunt completely the north and south rails. In such position, all of the impedance represented by the two halves of the loop 24 is effectively eliminated from the circuit and the maximum value of shunt current flows through the wheel-axle set. The total distance between the west and east boundary shunts 22 was typically arranged to be approximately eight feet.

It will be seen in the graphs of FIG. 2 that no output signal, that is, no output voltage from the pick-up coil 16 is realized until the center line is approached by the wheel-axle combination. This happens because the orientation of the coil 16 in the east-west direction is such that the coil is not significantly influenced by the fields produced by changing current flow in the loops since such fields are not appropriately oriented to induce a voltage in the coil. However, the wheel-axle shunt current is so oriented, as will be appreciated by reference to FIG. 1. Thus, fields at 90° in the vertical direction, due to current flow in the wheels 10, and in the north-south direction due to current flow in the axle 12, will induce voltages in the pick-up coil 16. The maximum voltage will be attained when the wheel-axle combination reaches the center line.

As the wheel-axle combination passes the center line, it will be understood that a sharp corresponding decreasing effect on coil response as seen in the curve 52 will take place. There is also, of course, a decrease in values for the curve 50 already described; that is, the shunt current likewise declines with wheel position beyond the center line because the signal source 28 then sees an increasing impedance due to movement of the wheel-axle combination away from the feed point connection C and D, made to the rails. This increasing impedance is due to the impedance of the rails between wheel-axle set location and the feed point connection.

A further curve illustrates the coupling coefficient; that is to say, the curve designated 54 demonstrates how well the pick-up coil couples with the shunt current flowing in the wheel-axle combination versus the distance from the detection zone center line. Each time the distance from the detection zone center line to the departing wheel-axle set position doubles, the coupling efficiency between the pick-up coil and the wheel-axle shunt current is reduced to one-half its previous value. This factor is the main reason for the sharply defined response of the pick-up coil output as related to the wheel-axle position from the detection zone center line.

Figure 4:
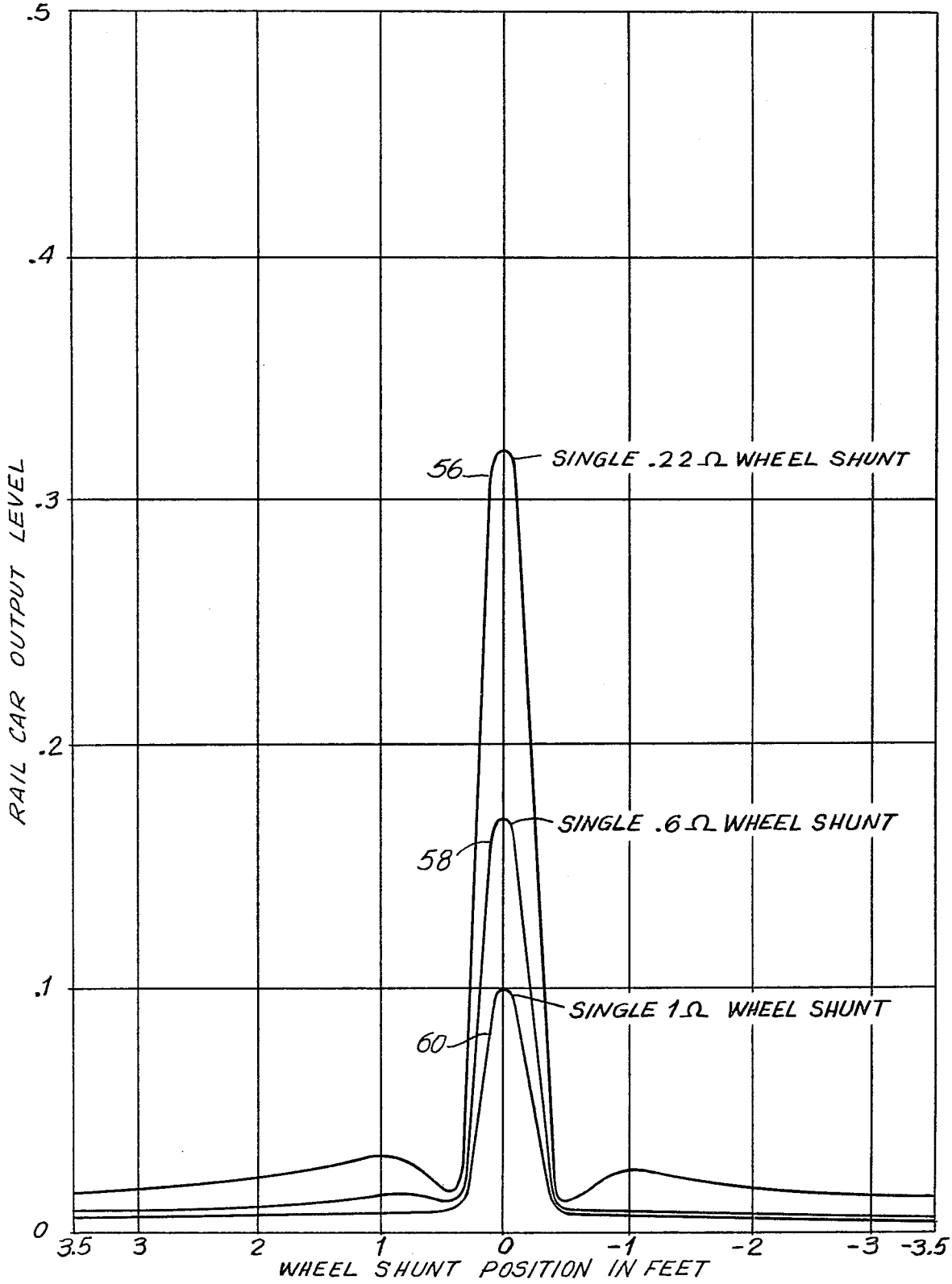
FIG. 4 is a graph illustrating the rail coil output level (in volts) versus the wheel shunt position (in feet), the third parameter being wheel shunt impedance.

FIG. 4 illustrates some typical output voltage signals as a result of tests performed with different impedance axles passing through the wheel detection zone 20 in accordance with the system of FIG. 3. It will be noted that curve 56 represents the rail coil output voltage when there is a single wheel shunt present having an impedance of 0.22 ohms; whereas the other two curves, that is, 58 and 60, represent the coil output levels when the single wheel shunt impedance is 0.6 ohms and 1 ohm, respectively. The 0.22 ohm impedance is representation of a good shunting axle while 1 ohm impedance value represents a poor shunting axle at a typical signal frequency of 13 KHz.

Figure 5:
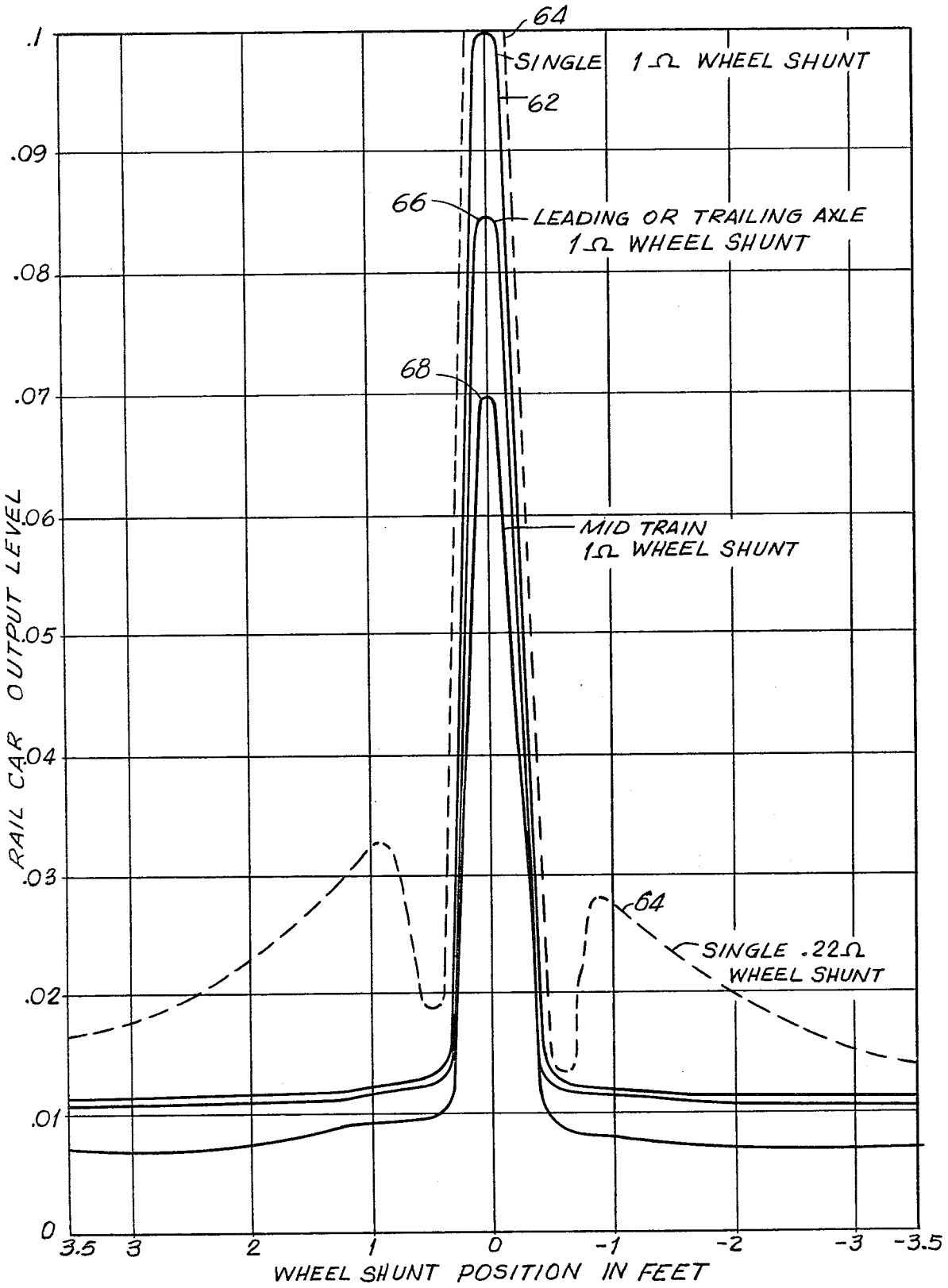
FIG. 5 is a graph similar to FIG. 4 but indicating various adjacent wheel-axle set configurations.

Domestic railroad cars most generally have two-axle trucks at each end of the car, so that there is at least one other axle within 5–6 feet of the axle being sensed. Generally the pair of wheel-axle sets at the far end of a car are physically too far removed from the detection zone to have any influence on the performance of the wheel detector. On the other hand, the second axle on the same truck or the near end wheel-axle sets on the adjacent coupled railroad car are close enough to affect the output response of the wheel detector. FIG. 5 illustrates the effect of adjacent wheel-axle sets with curves 62, 66 and 68 representing poor shunting axles with a 1 ohm impedance value. Also shown in this figure is dashed curve 64, which is just the lower or skirt portion of curve 56 of FIG. 4, showing the response of a good 0.22 ohm impedance axle. This so-called "skirt level" can be considered a "noise" level which the wheel detector must discriminate against. Curve 62 represents the response of a single poor shunting 1 ohm impedance wheel-axle set. From a practical sense this configuration never exists for domestic railroad cars. Curve 66 represents a leading or trailing 1 ohm impedance wheel-axle set response, where the adjacent interfering axle or axles are all located to one side of the axle being detected. Curve 68 represents a 1 ohm impedance wheel-axle set response which is within a train and has interfering axles on each side of the detection zone. As can be seen, adjacent interfering axles reduce the output response level of the wheel detector. This is of no consequence as long as the response of the poorest wheel-axle set under the worst case adjacent axle configuration is greater than the skirt "noise" response of the best shunting wheel-axle set, which is the case illustrated in FIG. 5. In essence, the difference in the poorest axle response and the best axle skirt noise response represents the "signal-to-noise" ratio for this wheel detection scheme.

It will be understood that in the FIG. 5 depiction of the characteristics of the good and the poor axles by means of the curves 64 and 62, respectively, only the lower part of the good shunting axle curve appears on the graph; however, such curve 64 would extend to a much greater maximum or peak value, as seen in the curve 56 of FIG. 4 to which curve 64 corresponds. This was done on the graph so that the poor curve 62, which corresponds with curve 60 in FIG. 4, could be appreciated; otherwise its peak or maximum would hardly be sensible relative to the curve 64. The scale for the curves seen in FIG. 5 is one-tenth of the scale for the curves in FIG. 4.

Referring now to FIG. 6, this shows a modification of the basic scheme or system of FIG. 3, being adapted for a situation where other track circuits, constituting part of other systems, are involved; that is, where other high-frequency signals are being used and it is desired that interference and undesirable loading between the different systems be prevented. Accordingly, the simple boundary shunts 22 seen before on FIG. 3 are replaced with series resonant circuits 70, which act as short circuits to the particular wheel detector frequency that has been selected (typically 13.4 KHz). These series resonant circuits 70 act as high impedances to other track circuit frequencies. The signal source 28 would also include a series tuned circuit 70 to eliminate the loading effect of it on the other track circuit signals.

Referring now to FIG. 7, there is shown another embodiment of the system of the present invention, which differs from the first embodiment depicted in FIG. 3 in that two separate pickup coils 80 and 82 are mounted typically one-half foot on either side of the center line of detection zone 20. The orientation is such that the coils are sensitive to the feed wire along the rail, that is, to the wire constituting the loop 26 and to the current through the loop 24 defined by rails 14.

With no axles in the vicinity of the wheel detector formed by the balanced coils 80 and 82, the feed current through each leg of the feed wire or loop 26 is essentially equal to the current flowing through each half of the rails 14, assuming that the feed and shunt arrangement is properly balanced. As a result, the pick-up coils 80 and 82 generate a minimum output because the field generated by the feed wire current cancels the field generated by the rail current. If a shunting axle is located between the two pick-up coils, a large feed wire current exists but a much smaller rail current exists. Consequently, a substantial output voltage is generated from each pick-up coil. The two coils 80 and 82 are connected in series so that for this condition the output from the two coils are additive. With this particular phasing, the system of FIG. 7 tends to cancel out, to a high degree, the shunting effect of other axles outside of the region between the two coils. It also cancels out interference by other foreign currents in the rails, such as traction current and track circuit currents.

Referring now to FIG. 8, yet another embodiment is therein illustrated. In this scheme, the source of high frequency signals is connected directly in shunt across the north and south rails. A loop is again formed, as before in FIG. 3, that is, an outer loop 24 is defined by the north and south rails 14 and by the boundary shunts 22. However, the inner loop here designated 90 constitutes a pick-up signal loop, that is to say, the arrangement is such that a voltage is induced in this loop indicative of wheel-axle presence.

With the scheme as depicted in FIG. 8, minimum output voltage is derived when there is no train in the vicinity of the detector and also when an isolated axle is at the center of the detector. As a single axle rolls through the detector zone 20, the output signal increases on the approach and then decreases to zero and switches phase 180 degrees at the center of the detection zone. As the axle or wheel-axle combination departs, the signal value increases and then decreases again. In other words, a sinusoid characteristic is obtained.

Although the scheme of FIG. 8 may be found to be useful, it is necessary to eliminate displacement of the signal level that occurs when there are other axles in the vicinity of the testing or detection zone.

What has been disclosed herein is a wheel detector system which provides great reliability since it has no moving parts and which is sensitive to both moving and static railroad wheels. As noted previously, the preferred embodiment is that illustrated in FIG. 3 which uses the rail-mounted pick-up coil since this detection scheme has the widest operating margin and the sharpest definition. However, the other schemes illustrated are susceptible to be adapted for use in detecting the presence of wheel or wheel-axle combinations. Additionally, it should be noted that, although a rail-mounted pick-up coil was illustrated in the preferred embodiment of FIG. 3, it is possible to position the pick-up coil in the center of the detection zone, midway between the two rails, so as to realize substantially the same effects described before.

While there have been shown and described what are considered at present to be the preferred and alternate embodiments of the present invention, it will be appreciated by those skilled in the art that modifications of such embodiments may be made. It is therefore desired that the invention not be limited to these embodiments, and it is intended to cover in the appended claims all such modifications as fall within the true spirit and scope of the invention.

What is claimed is:

1. A system for detecting the presence and position of wheel-axles on railroad cars comprising:

a pair of rails;

a transmitter or signal source having a high frequency output;

a pair of current carrying loops, the first loop including said pair of rails and a pair of boundary shunts connecting said rails so as to define a detection zone;

the second loop extending in close proximity to and inside said first loop, said first and second loops being subdivided for current flow into two substantially equal portions with respect to a center line of said detection zone;

said transmitter being coupled to said pair of loops, and being connected to said first loop on said center line; and, sensing means oriented for sensing field changes due substantially only to the direction of wheel-axle shunt current flow when a wheel-axle contacts said rails in said detection zone, said sensing means being insensitive to the fields produced by the currents flowing in said loops.

2. A system as defined in claim 1, further including a pick-up coil positioned adjacent one of said rails.

3. A system as defined in claim 1 in which said pair of loops is connected in series with said transmitter.

4. A system as defined in claim 2 in which one of said pair of rails is the north rail and the other is the south rail, and in which said pick-up coil has its axis oriented in an east-west direction such that induced EMF's in said coil due to currents flowing in said loops are minimized and rejected regardless of the presence of wheel-axle sets in the detection zone.

5. A system as defined in claim 4 in which said pick-up coil has its axis oriented in an east-west direction such that induced EMF's in said coil due to foreign currents flowing in the rails are minimized and rejected.

6. A system as defined in claim 4 in which said pick-up coil has its center line aligned with the center line of said detection zone, and in which connection from said signal source is made to said first loop and to said second loop on said center line.

7. A system as defined in claim 1 in which a series tuned circuit is included in each of said boundary shunts and in which a series tuned circuit is connected directly to said signal source.

* * * * *